US012595724B1

(12) United States Patent
Knappe

(10) Patent No.: US 12,595,724 B1
(45) Date of Patent: Apr. 7, 2026

(54) SYSTEM FOR CAPTURING AND DEPLOYING NATURAL GAS FROM WELLHEAD OF OIL AND GAS WELLS

(71) Applicant: AAA Partners, LLC, Barnsdall, OK (US)

(72) Inventor: Robert Knappe, Barnsdall, OK (US)

(73) Assignee: AAA Partners, LLC, Barnsdall, OK (US)

( * ) Notice: Subject to any disclaimer, the term of this patent is extended or adjusted under 35 U.S.C. 154(b) by 0 days.

(21) Appl. No.: 18/339,228

(22) Filed: Jun. 21, 2023

Related U.S. Application Data

(60) Provisional application No. 63/358,092, filed on Jul. 1, 2022.

(51) Int. Cl.
*E21B 43/12* (2006.01)

(52) U.S. Cl.
CPC ..... *E21B 43/122* (2013.01)

(58) Field of Classification Search
CPC ..... E21B 43/12
See application file for complete search history.

(56) References Cited

U.S. PATENT DOCUMENTS 5,911,278 A * 6/1999 Reitz ..... E21B 43/121 166/372
6,315,048 B1 * 11/2001 Etzkorn ..... E21B 43/121 95/254
6,622,791 B2 9/2003 Kelley et al.
6,755,251 B2 6/2004 Thomas et al.
(Continued)

FOREIGN PATENT DOCUMENTS

CN 104533350 4/2015
JP 6335605 5/2018
(Continued)

OTHER PUBLICATIONS

Natural Gas Compressor Station Intro and Overview [Oil & Gas Training Basics], Kimray Inc., published Apr. 9, 2020 (https://www.youtube.com/watch?v=3SpiUnpvc6c).
(Continued)

*Primary Examiner* — William D Hutton, Jr.
*Assistant Examiner* — Avi T Skaist
(74) *Attorney, Agent, or Firm* — Margaret S. Millikin

(57) ABSTRACT

A method and apparatus for capturing natural gas at the wellhead and enhancing production and efficiency, comprising a suction pressure regulator to control annular pressure on the wellhead, a suction scrubber to receive natural gas and allow condensation or fluid within the gas stream from the annulus to accumulate before entering a compressor, a compressor, a power source, a bypass pressure regulator, a discharge pressure regulator and a discharge scrubber. The compression system compresses natural gas from the well until the operating pressure set by the discharge pressure regulator is achieved and the pump is activated. The bypass pressure regulator allows natural gas to circulate from the discharge side to the suction side until a sufficient volume is achieved to charge the system at an appropriate operating pressure. Then, the pump delivers fluid from the well into a flow line, which goes to a separator/tank facility for normal processing.

34 Claims, 5 Drawing Sheets

(56) References Cited

U.S. PATENT DOCUMENTS

| | | | | |
|---|---|---|---|---|
| 6,991,034 | B2 | 1/2006 | Wilde | |
| 7,270,186 | B2 | 9/2007 | Johnson | |
| 7,275,599 | B2 | 10/2007 | Wilde | |
| 7,610,955 | B2 | 11/2009 | Irwin, Jr. | |
| 7,841,288 | B2 | 11/2010 | Lee et al. | |
| 8,232,438 | B2 | 7/2012 | Jones et al. | |
| 8,297,356 | B2 | 10/2012 | Balczewski | |
| 8,523,481 | B2 | 9/2013 | Schimp | |
| 8,789,609 | B2 | 7/2014 | Smith et al. | |
| 8,960,309 | B2 | 2/2015 | Davis | |
| 9,127,774 | B2 * | 9/2015 | Wilde | E21B 34/06 |
| 9,169,778 | B2 | 10/2015 | Allam | |
| 9,850,744 | B2 | 12/2017 | Zhang et al. | |
| 9,970,280 | B2 | 5/2018 | Athirathnam | |
| 10,155,194 | B2 | 12/2018 | Wang et al. | |
| 10,173,840 | B2 | 1/2019 | Oates | |
| 10,408,034 | B2 | 9/2019 | Beauquin et al. | |
| 10,415,603 | B1 | 9/2019 | Sommese | |
| 10,570,712 | B2 | 2/2020 | Mujica et al. | |
| 10,612,348 | B2 | 4/2020 | Kamler et al. | |
| 10,612,537 | B2 | 4/2020 | Hodges et al. | |
| 11,136,875 | B2 | 10/2021 | Ayub | |
| 11,162,493 | B2 | 11/2021 | Melo et al. | |
| 2002/0053426 | A1 * | 5/2002 | Kelley | E21B 43/121 166/67 |
| 2004/0123987 | A1 | 7/2004 | Reitz | |
| 2007/0062704 | A1 | 3/2007 | Smith | |
| 2009/0008101 | A1 | 1/2009 | Coady | |
| 2009/0194291 | A1 | 8/2009 | Fesi et al. | |
| 2012/0000668 | A1 | 1/2012 | Rexillus et al. | |
| 2014/0231093 | A1 | 8/2014 | Hoell | |
| 2015/0034320 | A1 | 2/2015 | Zubrin et al. | |
| 2021/0262327 | A1 | 8/2021 | Berland | |

FOREIGN PATENT DOCUMENTS

| | | |
|---|---|---|
| RU | 2706980 | 11/2019 |
| RU | 2708430 | 12/2019 |
| WO | 2016208050 | 12/2016 |
| WO | 2018109892 | 10/2019 |
| WO | 2020036493 | 2/2020 |

OTHER PUBLICATIONS

Natural Gas Well Completion in the Marcellus Shale, Chesapeake Energy, published May 23, 2012 (https://www.youtube.com/watch?v=bYKQDjcil3o).

"Natural Gas Pipeline Systems and Operations", Gas Processing & LNG, (http://gasprocessingnews.com/features/202004/natural-gas-pipeline-systems-and-operations.aspx) Sep. 28, 2022.

"Oil and Gas Production Handbook", ABB Oil and Gas, (https://new.abb.com/oil-and-gas/production-book/introduction), 2022.

"Natural Gas Well Production Problems" Arab Oil and Natural Gas, (https://www.arab-oil-naturalgas.com/natural-gas-well-production-problems/), Copyright 2022.

"The Defining Series: Plunger Lift", Oilfield Review, published Oct. 11, 2016, (https://www.slb.com/resource-library/oilfield-review/defining-series/defining-plunger-lift#:~:text=Plunger%20lift%20is%20an%20artificial,gas%20losses%20and%20methane%20emissions).

"Oil & Gas 101: Follow the Pipe on a Wellsite [How Production Equipment Operates]", Kimray Inc., (https://www.youtube.com/watch?v=WGFPb61qm9l).

* cited by examiner

SYSTEM FOR CAPTURING AND DEPLOYING NATURAL GAS FROM WELLHEAD OF OIL AND GAS WELLS

CROSS-REFERENCE TO RELATED APPLICATIONS

This application claims priority to U.S. provisional patent application Ser. No. 63/358,092, entitled System for Capturing and Deploying Natural Gas from Wellhead of Oil and Gas Wells, filed Jul. 1, 2022, the entirety of which is incorporated herein by reference.

TECHNICAL FIELD OF THE INVENTION

The present invention relates generally to systems and equipment for capturing and deploying natural gas at a wellhead of a hydrocarbon-producing well and for increasing production and efficiency of a hydrocarbon-producing well, and more particularly, but not by way of limitation, to closed loop, pressurized systems and equipment employing pressure regulators and gas lift mechanisms for capturing natural gas at a wellhead of a hydrocarbon-producing well and for increasing production and efficiency of a hydrocarbon-producing well. Methods of capturing and deploying gas at a wellhead and of increasing production and efficiency of a hydrocarbon-producing well are also provided.

SUMMARY OF THE INVENTION

The present invention is directed to a closed-loop system for capturing and deploying natural gas at a wellhead of a hydrocarbon-producing well, the well having a tubing string and a production casing and forming an annulus therebetween, the system comprising: a suction side; a discharge side; a compression system in fluid communication with the wellhead and with the suction side and the discharge side, the compression system comprising: a compressor; and a driver to power the compressor; a discharge pressure regulator in fluid communication with the discharge side and with the well for controlling the pressure of the closed-loop system; and a downhole pump configured to be in fluid communication with the compression system wherein the downhole pump employs gas pressure to lift fluids from the well independently from the operations of the well in the annulus and maintains a substantially constant low pressure on the annulus.

The present invention is further directed to a method for capturing natural gas at a wellhead of a hydrocarbon-producing well, the method comprising the steps of: capturing natural gas that is being produced at the well, and utilizing the captured natural gas to create a pressurized system to lift hydrocarbons from the well.

The present invention is directed to a unit for capturing and deploying natural gas at a wellhead of a hydrocarbon-producing well, the well having a tubing string and a production casing and forming an annulus therebetween, the system comprising: a suction side; a discharge side; a compression system in fluid communication with the wellhead and with the suction side and the discharge side, the compression system comprising: a compressor; a driver to power the compressor; and a discharge pressure regulator in fluid communication with the discharge side and with the well for controlling the pressure of the closed-loop system; and a downhole pump configured to be in fluid communication with the compression system wherein the downhole pump employs gas pressure to lift fluids from the well independently from the operations of the well in the annulus and maintains a substantially constant low pressure on the annulus.

DETAILED DESCRIPTION OF THE INVENTION

Figure 1:
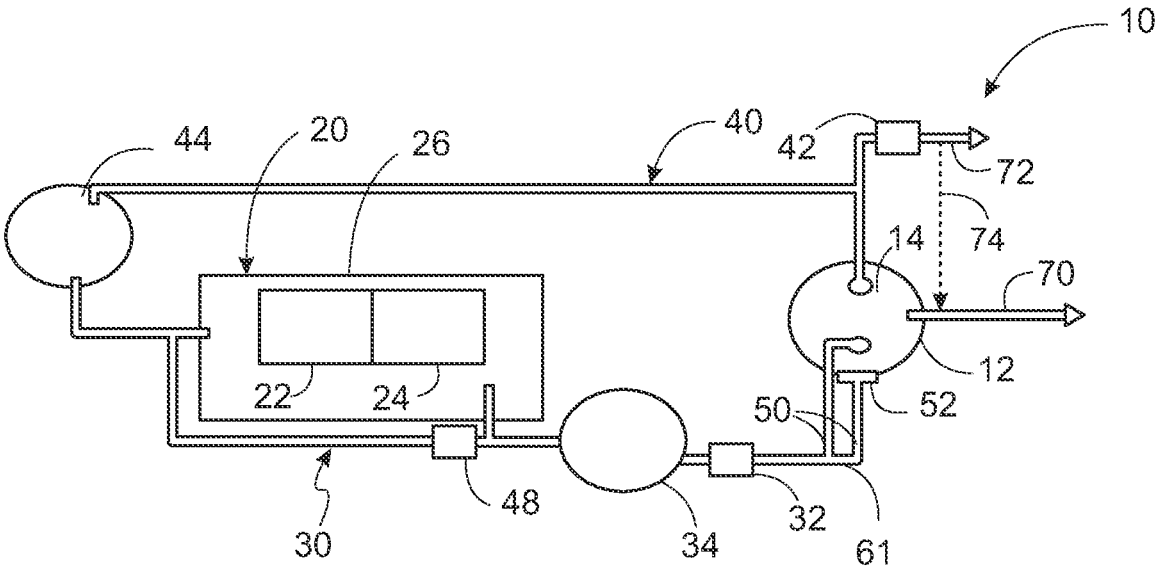
FIG. 1 is a schematic illustration of a gas capturing and deployment system constructed in accordance with an embodiment of the present invention.

The task of moving subterranean fluids, including oil, gas and slurries, from a reservoir to the surface of the earth, requires a system of equipment that typically includes an artificial lift mechanism, often a reciprocating-type positive displacement pump, positioned within the borehole of the well. The pump is connected, directly or indirectly, to a sucker rod string within the tubing in the borehole, which is positioned within the casing of the well. The sucker rod string cooperates with an artificial lift unit or pump jack that is powered by a prime mover, such as a combustion engine or electric motor. The sucker rod string reciprocates within the tubing in the borehole via motion of the artificial lift unit and transfers movement to the downhole pump.

Downhole pumps of the reciprocating type often have a plunger within a barrel and a series of inlet and outlet valves for receiving and discharging fluid. The barrel is attached to the end of the tubing, and the plunger is attached to the sucker rod string. Reciprocating action of the plunger charges a cavity disposed between a valves and lifts fluids through the tubing to the surface. Fluids flow into the pump through inlet valves on the suction, or up stroke, of the plunger as the cavity is expanding, and they are discharged through outlet valves on the discharge or down stroke as the cavity size decreases. Fluids discharged from the pump are forced up the tubing string to the wellhead where liquids and gases are separated and moved into production streams.

Problems can arise when gases are present. Some wells produce free gas, or gases entrained in liquid will come out of solution during production. If the produced fluid retains free gas, then the valves will not necessarily open or close at the top or bottom of the stroke. These gases may partially fill the cavity of the pump, displacing oil or other more desirable liquids, thereby adversely affecting the efficiency of the well. Additionally, the greater the volume of free gas, the greater the pumping action of the plunger is dedicated to expansion and compression of free gas rather than pumping fluids to the surface. Gases may overtake the cavity of the pump, causing gas lock. Gases trapped between valves prevent the pump from achieving sufficient pressure to move fluids up the tubing string.

Moreover, during the reciprocating movement of the string, gas may collect in the annular space between the casing and the tubing of the well. While the collection of gas can be beneficial, as it may force produced oil from the reservoir up the tubing string to the wellhead for further processing and sale, in some instances, gas also may restrict oil flow and decrease the productivity of the well. For example, gas may cause the pump to gas lock, particularly in tandem with the pressure created by the operating equipment at the wellhead. The productivity of a well generally is maintained or increased by reducing the pressure created by casinghead gas in the annular space.

These problems are compounded in wells with multiple completions. Upstream oil production using multiple string completion, comprising two or more tubing strings inside a well casing, is common due to its cost advantage. In dual string completion, a single well casing can house two tubing strings, which may be of different lengths due to production from different subterranean zones and located varying depths. Some wells may contain multiple strings of production tubing, depending upon the well, and may be different lengths to allow production from different zones. Gas lift for this type of completion can be difficult due to the operating condition where total gas is injected into the common annulus and then allowed to be distributed among the multiple strings, without any surface control.

Various methods and systems exist for addressing the problems attendant to gas from production of a well and, more particularly, to reducing pressure due to the presence of casinghead gas in the annular space between the casing and the tubing. As used herein, the terms "gas", "natural gas" and "casinghead gas" all may be used to refer to gas produced from an oil and gas well. These conventional methods of reducing gas buildup have various advantages and disadvantages. Venting gas at or near the wellhead into the ambient air, either continuously or periodically, conveniently and effectively reduces pressure buildup. This method is useful in areas where there is no economical option to bring the natural gas to market. Many of the mature oil and gas fields which have been developed in the United States contain oil and gas wells which are emitting or venting natural gas into the atmosphere at the surface from the wellhead. Venting natural gas, which has little or no value in some regions, allows wells to produce reservoir fluids containing oil, which does have value, when there is no market for the gas. This method, however, may impact the environment if methane or other impurities are present in the gas and released into the air.

Another option entails flaring, or burning, the gas at the wellhead, which is desirable for a number of considerations, including mitigating safety risks created by volatile pressures. As gas rises to the surface, sudden increases in pressure may cause explosions. Flaring the gas effectively reduces the pressure. Legal or regulatory requirements, economic justifications, and technical issues may warrant the use of flaring to reduce the pressure caused by casinghead gas and to increase production of valuable reservoir fluids from the well. However, flaring is considered by some to be wasteful or harmful to the environment. Billions of cubic feet of natural gas are burned each year, fueling complaints that this gas could be supplied to underdeveloped geographic regions where the energy is needed.

In some cases, oil and gas operators will use surface compressors, along with conventional rod-lift pumping equipment, to reduce annular pressure and to gather natural gas. If a well produces sufficient volumes of casinghead gas, wellhead compressors or vapor recovery units (VRU) may be employed at the surface of the well to collect and transport the casinghead gas for sale, for onsite use or into tank storage. Benefits include increased oil production, plus increased income from additional sales of the gas. This method incurs a significant capital investment, thus making it a viable option only for those wells producing a sufficient volume of gas and having electricity at the wellhead. The upfront capital costs for equipment, installation and electrical supply will limit applicability of this option.

The present invention overcomes the deficiencies associated with conventional means of resolving pressure buildup of casinghead gas. The present invention provides a solution whereby the natural gas at the surface is captured and processed through a compressor within a closed-loop system. The present invention eliminates the problems created by venting or flaring natural gas containing methane and other hydrocarbons into the atmosphere and threatening the environment. The present invention avoids the buildup of pressure in the annular space of a well, which impedes the flow of fluids into the well bore, thereby reducing the productive capacity of the well for marketable fluids. The present invention provides a pressurized system which can be utilized to lift fluid in the well, in the place of current and costly conventional equipment, and transports that fluid through flow lines to tank facilities by utilization of a specialized pump. The present invention provides sufficient gas pressure so that excess natural gas can be delivered into a gathering flow line or reintroduced into a primary combined flow line with the fluid, where the natural gas can then be separated at tank battery facilities. The present invention can be utilized to replace both surface compressors and conventional rod-lift pump equipment, so that operating costs are reduced, and production efficiency is increased. The present invention also reduces the operating costs associated with maintenance and production of a well because of lower costs compared with conventional pumps and equipment, thus extending the productive life of current wells without venting of natural gas into the atmosphere.

The present invention provides a novel system comprising a suction pressure regulator to control annular pressure on the wellhead, a suction scrubber to receive natural gas and allow condensation or fluid within the gas stream from the annulus to accumulate before entering a compressor, a compression system comprising a power source and a compressor, a bypass pressure, a discharge scrubber and a discharge pressure regulator, in fluid communication with a gas pump in the well. The compressor compresses natural gas flowing from the wellhead until the operating pressure set by the discharge regulator is achieved and the pump is activated. If necessary, the bypass regulator will allow natural gas to circulate from the discharge side of the compressor to the suction side of the compressor until a sufficient volume is achieved to fully charge the system at an appropriate operating pressure for the pump. At that point, the pump will start delivering fluid from the well bore into the flow line, which then goes to a separator/tank facility for normal processing. As the amount of natural gas available from the wellhead exceeds what is required to charge and maintain the operating pressure for the gas lift pump, it will exit the system through the discharge pressure regulator. Natural gas from the wellhead flows through the compression system, and then returns either to the pump to lift fluid or exits the system as excess gas, which is then collected with a dedicated gas flow line or is combined with the fluid from the pump into a main flow line, which then can be processed at the separator/tank facility associated with the well.

Figure 2:
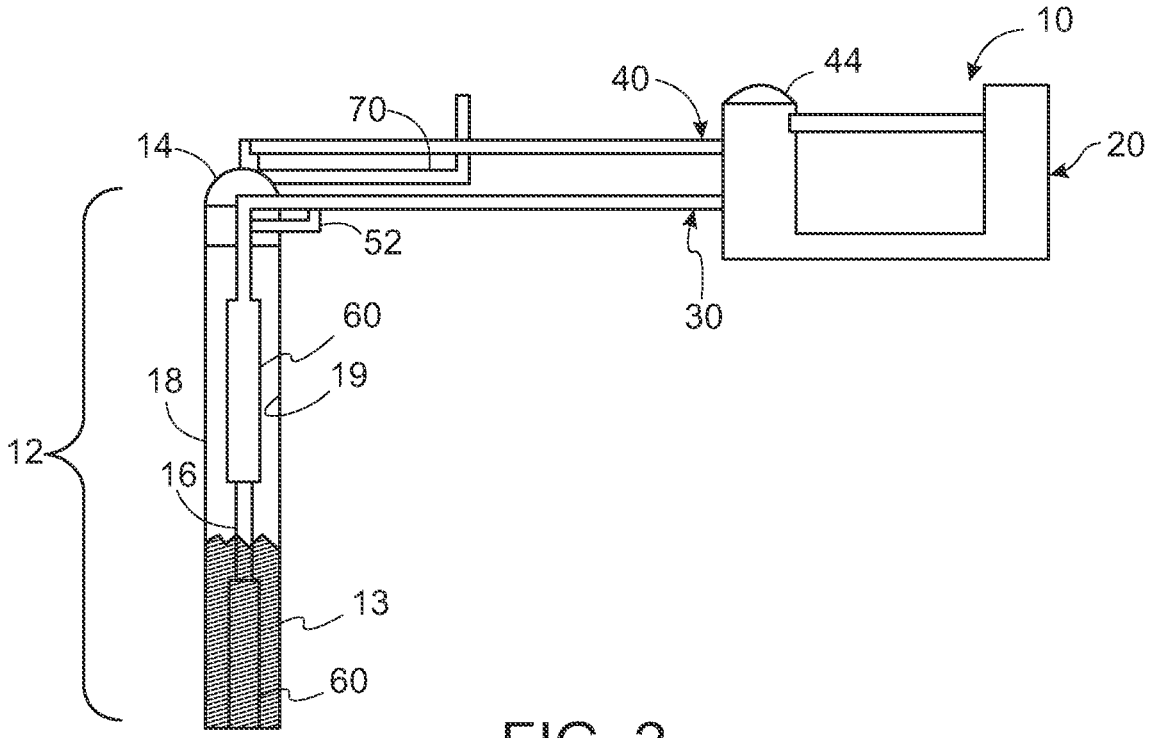
FIG. 2 is a schematic drawing of a subterranean well illustrating a wellbore in which a tubing string is suspended inside the wellbore and a pump in communication with an illustrative embodiment of the gas capturing and deployment system of the present invention.
Figure 3:
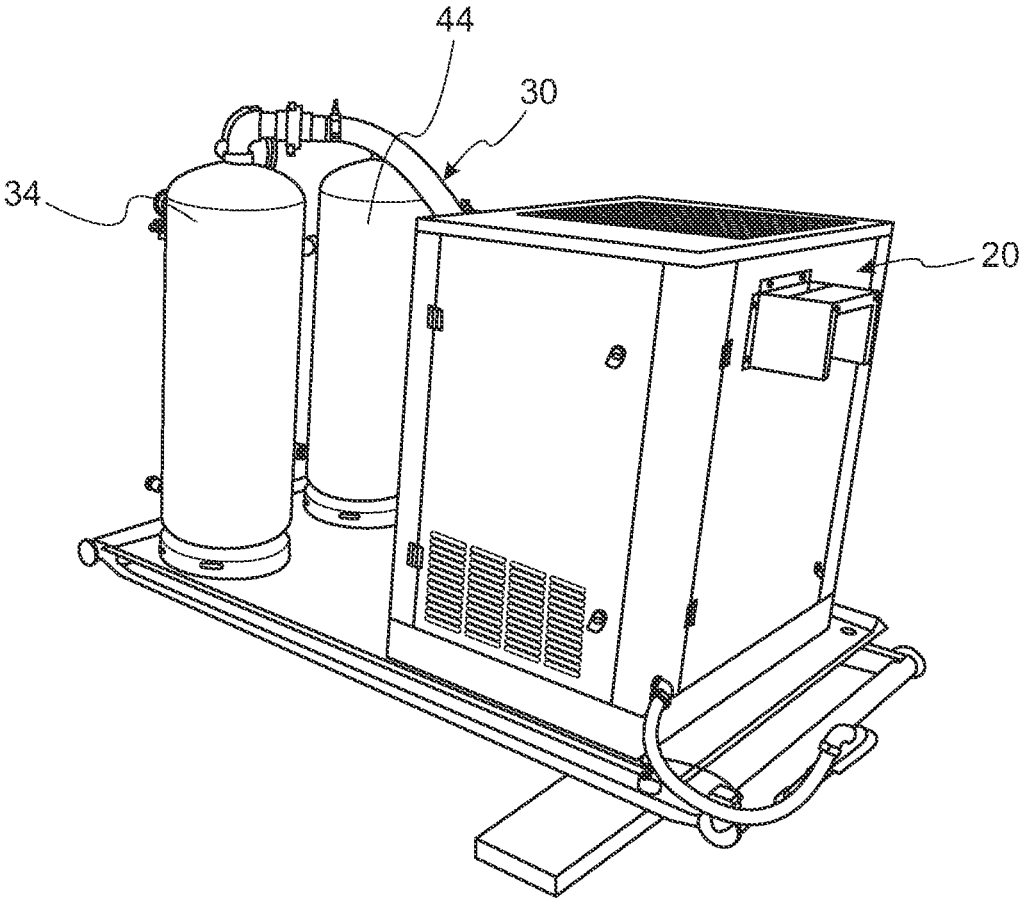
FIG. 3 is a perspective view at the surface of a well showing an illustrative embodiment of the gas capturing and deployment system of the present invention.

Turning now to the drawings in general, and to FIGS. 1, 2, and 3 in particular, there is shown therein an illustrative system for capturing and deploying natural gas 10 from a hydrocarbon-producing well 12 and for enhancing the production of fluids 13 therefrom. The components of the system 10 preferably, though not necessarily, comply with American Petroleum Institute (API) quality standards and dimensions. As used herein, fluids include gases, oils, vapors, viscous substances, heavy oils, water, slurries, cements and muds. The system 10 comprises a closed-loop pressurized system for capturing natural gas at a wellhead 14 of a hydrocarbon-producing well 12 and deploying the natural gas for enhancing the productivity and efficiency thereof, the well having a tubing string 16 and a production casing 18 and forming an annulus 19 therebetween.

The system for capturing and deploying natural gas 10 may comprise a compression system 20, comprising a compressor 22 and a driver 24, such as an engine or a motor, to power the compressor. The compression system 20 optionally may be accommodated inside a housing 26. The system for capturing and deploying natural gas 10 defines an inlet or suction side 30, comprising a suction pressure regulator 32 and a suction scrubber 34, and an outlet or discharge side 40, comprising a discharge pressure regulator 42 and a discharge scrubber 44. It will be appreciated that the location and operation of equipment and components on the suction side 30 need not necessarily be physically located on the suction side of the system 10, and that the location and operation of equipment and components on the discharge side 40 of the system need not necessarily be physically located on the discharge side. Depending upon conditions at the well 12 and the configuration of piping and other components at the wellhead 14, it will be understood that the location and operation of the equipment and components of the system 10, including those components affiliated with the suction side 30 and/or with the discharge side 40, respectively, are variable. FIG. 3 depicts one illustrative configuration of the components of the system 10.

Various fittings and connections connect the system for capturing and deploying natural gas 10 to the well 12. For example, fittings, lines and valves known in the art and generally represented by reference numeral 50 connect the system 10 to the wellhead 14. Connections 52 connect the system 10 to the annulus 19 of the well 12 and to a pump 60 for a purpose yet to be described. Fittings and valves generally represented by reference numeral 61 connect the system 10 to the wellhead 14.

The suction pressure regulator 32 is in fluid communication with the pump 60 to control pressure at the wellhead 14. As used herein, the "suction pressure regulator" 32 includes evaporating pressure regulators, condensing pressure regulators, crankcase pressure regulators, capacity regulators, hot-gas bypass regulators, back pressure regulators, vacuum pressure regulators, differential regulators, pressure control valves, pneumatic control valves, electric control valves, or pressure reducing regulators. The suction pressure regulator 32 maintains a low pressure on the annulus 19 of the well 12 and in one embodiment of the invention does not allow a vacuum to build up. By way of example, but without limitation, the suction pressure regulator 32 may be set to open at about 1 psi (about 0.007 MPa) and to turn off when the pressure on the well 12 reaches zero so that a vacuum is not pulled on the well.

The suction scrubber 34 is in fluid communication with the suction side 30 of the system 10 and with the suction pressure regulator 32 to receive natural gas from the well 12 and to condense and accumulate fluids out of the gas produced from the well, prior to entering the compression system 20. The suction scrubber 34 filters particulates, liquids and unwanted gases, such as carbon dioxide or hydrogen sulfide, from the gas entering the system 10 from the well 12. Various types of scrubbers are suitable for use as the suction scrubber 34 in the system for deploying and capturing natural gas 10, including spray towers, cyclone spray chambers, venturi scrubbers, orifice scrubbers, impingement scrubbers, packed bed scrubbers, and dry scrubbers. In one embodiment of the invention, the suction scrubber 34 is a stationary impingement scrubber having a vertical orientation wherein the scrubber liquid and the gas flow in the same direction. It will be appreciated that alternative orientations of the suction scrubber 34 may also be suitable in the system 10, including horizontal flow, in which the scrubber liquid flows perpendicular to the gas flow, or counter-current flow, in which the scrubber liquid flows opposite the gas flow. Flow orientation can affect collection efficiency, size, pressure drop, and gas velocity. The selection of a suction scrubber 34 for use in the system for deploying and capturing natural gas 10 will depend upon a variety of factors, including desired gas flow rates through the scrubber, the intended liquid flow rate of the scrubber liquid in the system, minimum particle size of the filtered indicates particulate matter, and the capture rate.

The compression system 20 is in fluid communication with the well 12 and is oriented to the wellhead 14 in a manner that the compression system communicates with the pump 60 via pipe, hose or fittings rated for the appropriate operating pressures, to connect the annulus 19 of the well 12 to the suction side 30 of the system 10, as shown at 52 in FIG. 1 and FIG. 2. The compressor 22 of the compression system 20 may be any compressor adapted for use in oil and gas production, including without limitation, a reciprocating cylinder compressor, a rotary screw compressor, an axial compressor, a centrifugal compressor, or any compressor capable of generating sufficient volume and pressure to charge the system 10 to the required operating pressure. A reciprocating compressor uses pistons and positive displacement to compress the gas, which enters a manifold (not shown) in the compressor 22, flows into a compression cylinder (not shown) and discharges at a higher pressure. In a reciprocating compressor, gas enters the compressor through an inlet where crankshaft-driven pistons push and compress the natural gas, increasing the pressure and temperature of the gas. A screw compressor uses a pair of helical screws or rotors in parallel to spin and compress gas. The natural gas enters the inlet with suction and moves around the threads of the screws, which compresses the gas as it goes through the machine. The gas is discharged on the other side of the compressor 22 at a higher pressure.

The compressor 22 may employ single or multiple stages of compression to cause fluids to condense and fall out of the gas for further processing. Smaller, single-stage compressors are used for lower volumes and pressures of natural gas and may be used to gather vapors and fugitive gases. Medium-sized compressors are often found at wellheads and gathering systems. Larger natural gas compressors may employ several stages of compression and are most often used at compressor stations along a pipeline that transports large quantities of natural gas but may be used at a wellhead. For example, in a three-stage compressor, the pistons compress gas entering the first stage to a desired pressure and temperature, for example, about 155 psi (about 1.07 MPa) and about 260 degrees Fahrenheit (about 132 degrees Celsius), after which the gas exits the first stage to an intercooler and is cooled to a desired temperature. The heating and cooling of the gas causes liquids to condense from the gaseous state, after which the liquids enter a scrubber for further processing and remaining gas enters a second stage of compression. The second stage of the gas increases the pressure and temperature of the gas to even higher levels than during the first stage, for example, about 490 psi (about 3.4 MPa) and 270 degrees Fahrenheit (about 127 degrees Celsius), then cools the gas again to induce more fluids to condense for treatment and transport. The third stage of compression once again heats the remaining gas to even higher temperatures, for example, about 1200 psi (about 8.3 MPa) and about 300 degrees Fahrenheit (about 149 degrees Celsius), after which the condensate is transported to a scrubber. In one embodiment of the invention, a single stage compressor with an operating pressure of 150 psi (1.03 MPa) is suitable for use in the natural gas capturing and deployment system 10, while in another embodiment a longer stage or a different pump requiring higher pressure may require the use of a three-stage compressor or a package with multiple compressors in parallel. Where more than one compressor 22 is desired, the compressors may be linked in series or in parallel.

It will be understood that the compressor 22 is powered by a driver 24, such as an engine or electric motor. Single cylinder engines are common in oilfields and are sufficient to power the compressor 22, although it will be understood that drivers 24 comprising multi-cylinder engines and multiple engines or motors may be employed in the system 10, depending on conditions at the well 12. The driver 24 may be powered by gasoline, diesel, or natural gas taken from the system 10. The power requirements for the system 10 are variable and depend upon the conditions at the wellhead 14, including operating volumes and pressures of the gas being moved through the system 10 and pressures at the wellhead 14 and the size of the compressor 22 employed in the system 10. In one embodiment of the invention, the power produced by the driver 24 may range in capacity from about 5 hp to about 25 hp, depending upon requirements and conditions at the well 12 and the size of the compressor 22.

The compressed gas from the compression system 20 enter the discharge scrubber 44. The discharge scrubber 44 again filters particulates, liquids and unwanted gases, such as carbon dioxide or hydrogen sulfide, from the gas entering the system 10 from the well 12. Various types of scrubbers are suitable for use as the discharge scrubber 44 in the system for deploying and capturing natural gas 10, including spray towers, cyclone spray chambers, venturi scrubbers, orifice scrubbers, impingement scrubbers, packed bed scrubbers, and dry scrubbers. In one embodiment of the invention, the discharge scrubber 44 is a stationary impingement scrubber having a vertical orientation wherein the scrubber liquid and the gas flow in the same direction. It will be appreciated that alternative orientations of the discharge scrubber 44 may also be suitable in the system 10, including horizontal flow, in which the scrubber liquid flows perpendicular to the gas flow, or counter-current flow, in which the scrubber liquid flows opposite the gas flow. Flow orientation can affect collection efficiency, size, pressure drop, and gas velocity. The selection of a discharge scrubber 44 for use in the system for deploying and capturing natural gas 10 will depend upon a variety of factors, including desired gas flow rates through the scrubber, the intended liquid flow rate of the scrubber liquid in the system, minimum particle size of the filtered indicates particulate matter, and the capture rate The discharge scrubber 44 is in fluid communication with the discharge side 40 of the system 10 and with the discharge pressure regulator 42, which maintains operating pressures at the desired levels on the discharge side 40 of the system and allows excess gas to be released into a flow line 72 for delivery to another system for containing or selling natural gas coming from the well 12. As used herein, the "discharge pressure regulator" 42 means and includes evaporating pressure regulators, condensing pressure regulators, crankcase pressure regulators, capacity regulators, hot-gas bypass regulators, back pressure regulators, vacuum pressure regulators, differential regulators, pressure control valves, pneumatic control valves, electric control valves, or pressure reducing regulators.

One of the primary functions of the discharge pressure regulator 42 is to maintain the desire operating pressure on the pump 60 in the well 12. In one embodiment of the invention, the discharge pressure regulator 42 maintains an operating pressure ranging from about 120 psi to 150 psi, based on conditions at the well 12 and the requirements of the pump 60. The pressure may be lower or higher, based on the amount of lift required to move fluids 13 from the well 12. In one embodiment of the invention, the discharge pressure regulator 42 is primarily responsible for controlling the pressure at the well 12, and the suction pressure regulator 32 supports and works in tandem with the discharge pressure regulator 42 to achieve desired pressures at the well 12. By way of example, but without limitation, the suction pressure regulator 32 may be set to open at about 1 psi (about 0.007 MPa) and to turn off when the pressure on the well 12 reaches zero so that a vacuum is not pulled on the well. The operating pressures of the discharge pressure regulator 42 are based on conditions at the well 12 and preferably are sufficient to hold back pressure needed for the pump 60.

The system 10 may comprise a bypass pressure regulator 48, which opens to allow the bypass of natural gas from the discharge side 40 to the suction side 30 of system 10 when there is insufficient gas available from the wellhead 12 to selectively pressurize the pump 60 or the system 10 overall. After gas is delivered to the compression system 20 from the suction side 30 of the system 10, the compressor 22 compresses gas flowing from the wellhead 14 until the operating pressure set by the discharge pressure regulator 42 is achieved and the pump 60 is activated. If necessary, the bypass pressure regulator 48 will allow gas to circulate from the discharge side 40 of the system 10 to the suction side 30 of the system until a sufficient volume is achieved to fully charge the system at an appropriate operating pressure for the pump 60. At that point, the pump 60 will start delivering fluid from the well bore into the flow line 70, which then goes to a separator/tank facility for normal processing. The bypass pressure regulator 48 circulates gas from the discharge side 40 of the compression system 20 to the suction side 30 of the system 10. As used herein, the "bypass pressure regulator" 48 means and includes evaporating pressure regulators, condensing pressure regulators, crankcase pressure regulators, capacity regulators, hot-gas bypass regulators, back pressure regulators, vacuum pressure regulators, differential regulators, pressure control valves, pneumatic control valves, electric control valves, or pressure reducing regulators. One such bypass pressure regulator 48 employs a spring and piston design, and these are suitable for use in the natural gas capturing and deployment system 10 of the present invention, although it will be appreciated that alternative bypass pressure regulators may be employed in the system.

The bypass pressure regulator 48 maintains constant flow within the closed-loop natural gas capturing and deployment system 10. The bypass pressure regulator 48 allows gas to enter the suction side 30 from the discharge side 40 until the system 10 is fully charged and reaches the desired operating pressure to run the pump 60. When the compressor 22 does not yet have enough volume entering from the well 12 (both annulus and pump exhaust) to operate and continue to build pressure, the bypass pressure regulator 48 will open, when the pressure at the suction side 30 goes below a set pressure, and allow gas to circulate from the discharge side 40 to the suction side 30.

The bypass pressure regulator 48 also provides a back-up to the suction pressure regulator 34. When the pressure on the suction side 30 of the system 10 drops below a certain pressure, the bypass pressure regulator 48 will open to allow gas to enter the suction side 30 from the discharge side 40. If the suction pressure regulator 32 closes to avoid a vacuum on the annulus 19 of the well 12, then the bypass pressure regulator 48 will open to allow gas to circulate until such time as the pressure increases on the annulus 19 and the suction pressure regulator 32 opens to again allow gas to flow from the well 10.

Figure 4C:
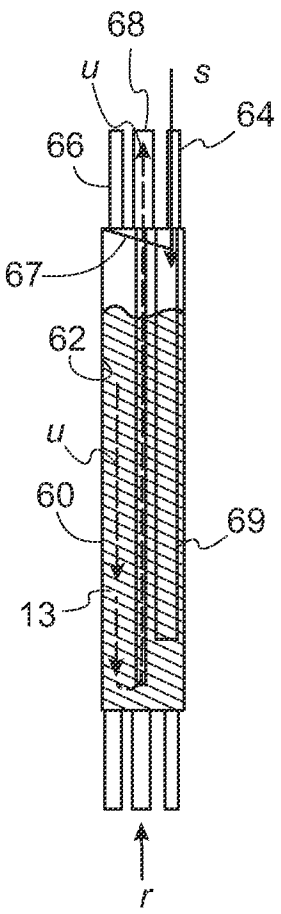
FIG. 4C shows a filling cycle of the illustrative pump of FIG. 4B wherein a float switch in the pump is activated to permit compressed gas to enter a chamber of the pump in order to displace fluid.

It now will be appreciated that the pump 60 comprises a downhole mechanism that employs gas pressure to lift fluids 13 from the well 12 within a closed-loop, independently from the annular space 19 in the well. The pump 60 additionally may return gas either to the annular space 19 or to the wellhead 14 through a designated line 66 as shown in FIGS. 4C, 5A and 5B. Suitable pumps 60 for use in the gas capturing and deployment system 10 include a gas lift pump or a bubble pump. Alternatives to the pump 60 include a pressure valve and a downhole regulator to lift fluids from the well 12 and which may permit venting into the annulus 19.

It will be appreciated that operation of the pump 60 is isolated from production operations in the annulus 19 of the well 12. Fluids produced from the producing formation of the well 12 are pumped to the surface through a separate tubing string or poly line and are not delivered to the compressor 22. Only gas from the annulus 19 or from the discharge of the pump 60 will be delivered to the suction side 30 of the system 10. Fluids present in the natural gas capturing and deployment system 10 will be from moisture or natural gas condensate dropping out of the gas flow from the well 12 as it is processed through the suction scrubber 34 or through the discharge scrubber 44.

The operation of the pump 60 in connection with the system for capturing and deploying natural gas 10 is now described. Turning now to FIGS. 4A, 4B and 4C and FIGS. 5A, 5B and 5C, a pump 60 having a pump chamber 62 is installed into the well 12 inside the casing (not shown). In one embodiment of the invention, multiple pumps 60 may be installed in the well and are spaced in a manner necessary to produce fluid from multiple desired depths in the well. When multiple pumps 60 are installed, each pump 60 defines a pump stage, wherein each pump is connected to the other pumps. The pump 60 is connected to the wellhead 14 with three tubing strings, or flow lines. A first tubing string 64 delivers compressed gas from the surface 14 at pressure to the pump 60, or to each of the multiple pumps 60 when more than one stage is installed, in the direction s in order to provide the necessary energy to lift fluid 13 from the well 12. A second tubing string 66 is utilized to deliver vented or exhaust gas from the pump 60, or multiple pumps 60, in direction v to the wellhead 14 after each pump cycle, where this gas is combined with annulus gas and delivered to the compression system 20. Each pump 60 vents gas after a pump cycle to release pressure and allow more fluid 13 to enter the pump chamber 62 of the pump 60. A third tubing string 68 is utilized to deliver fluid from the pump 60 to the wellhead 14.

Figure 4B:
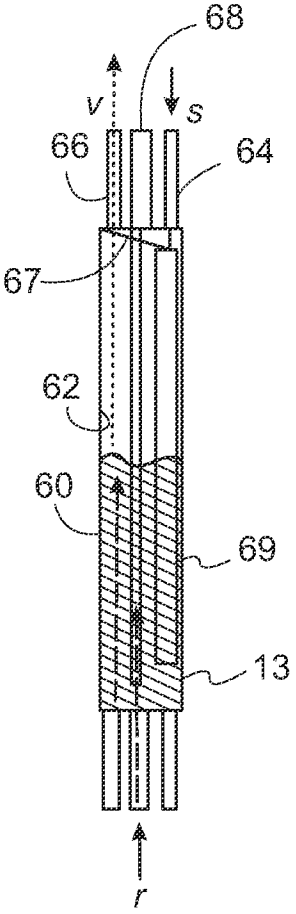
FIG. 4B shows a filling cycle of the illustrative pump of FIG. 4A wherein gasses in the fluids from the well are vented to minimize a build-up of pressure in the pump.
Figure 4A:
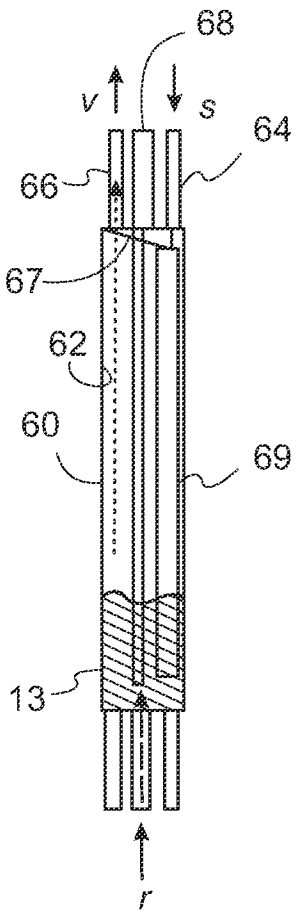
FIG. 4A shows a filling cycle of an illustrative pump suitable for use in the present invention wherein the pump begins to fill with fluids from the well.

Turning now to FIGS. 4A, 4B and 4C, the filling cycle is described. As shown in FIG. 4A, the pump chamber 62 begins to fill with fluid 13 from the bottom of the pump 60 in direction r. Fluid 13 enters the pump chamber 62 from the annulus 19 or is being lifted by the preceding pump stage. As fluid enters the pump chamber 62, any remaining gas from the preceding cycle is vented through the second tubing string 66 and moves up the second tubing string 66 until it reaches the wellhead 14 at the surface. As shown in FIG. 4B, as the pump cycle progresses, fluid 13 continues to fill the pump chamber 62 from direction r. As fluid 13 fills the pump chamber 62, any remaining gas is vented in direction v through tubing string 66 in order to avoid a build-up of pressure.

As shown in FIGS. 4C and 5A after the pump chamber 62 has filled, a float switch 67 of a pump float 69 is activated which allows compressed gas to enter the pump chamber 62 through tubing string 64 in the direction s in order to displace fluid in the pump 60. With continuing reference to FIG. 4C, as the float switch 67 of the pump float 69 activates the gas pressure, tubing string 66 is closed to keep gas from exiting the pump chamber 62. With continuing reference to FIGS. 4C and 5A, as compressed gas enters the pump chamber 62, it displaces the fluid 13 which has entered the pump 60 and lifts the fluid 13 in the direction u from the pump 60 through the tubing string 68 to the next pump stage, or eventually to the surface.

Figure 5C:
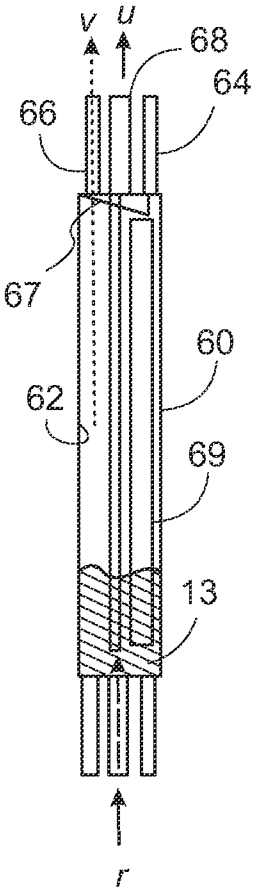
FIG. 5C shows a pumping cycle of the illustrative pump of FIG. 5B wherein a float switch stops the flow of gas into the pump and gas is vented from the pump, allowing fluid to enter and fill the pump and initiate another pump cycle.
Figure 5B:
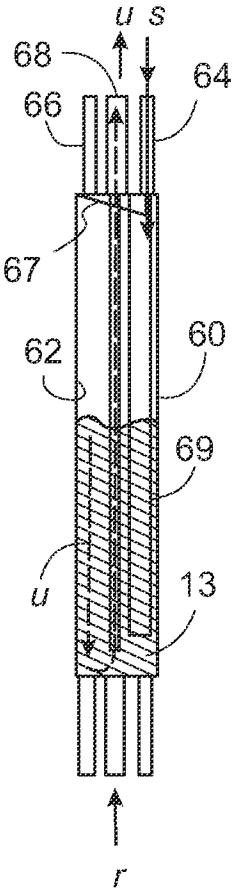
FIG. 5B shows a pumping cycle of the illustrative pump of FIG. 5A wherein fluid continues to be lifted as it is displaced by compressed gas, through a flow line up to the next pump chamber or to the surface.
Figure 5A:
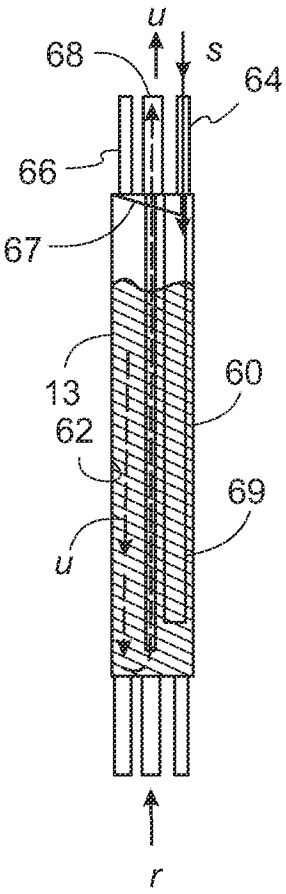
FIG. 5A shows a pumping cycle of the illustrative pump of FIG. 4C wherein compressed gas continues to displace fluid from the pump to the surface through a flow line.

Turning now to FIGS. 5A, 5B and 5C, the pumping cycle is described. As shown in FIG. 5A, compressed gas continues to displace fluid 13 from the pump chamber 62 up through the tubing string 68 in direction u. As shown in FIG. 5B, fluid 13 continues to be lifted as it is displaced, through the tubing string 68 up to the next pump chamber, in the case of multiple pumps 60, or to the wellhead 14. As shown in FIG. 5C, after the fluid 13 is sufficiently displaced out of the pump chamber 62 by compressed gas, the float switch 67 of the pump float 69 disengages, stopping the flow of gas into the pump 60. At the same time, the float switch 67 deactivates the gas pressure, and the tubing string 66 is opened again to vent gas to from the pump chamber in direction v. Fluid 13 then begins to enter the pump chamber 62 to start another pump cycle.

The desirable operating pressures to charge the natural gas capturing and deployment system 10 depend on the depth and operating conditions at the well 12. For example, if the well is 300 feet deep, only a single-stage pump 60 may be necessary to overcome pressure of the hydrostatic fluid 13 to pump the fluid to the wellhead 14. As used herein, a "stage" means a length of one or more strings of tubing between the pump 60 and the wellhead 14. If the well 12 is 2000 feet deep, eight stages with spacing of 250 feet each may be required. Operating pressures may range from about 50 psi (about 0.34 MPa) to about 200 psi (about 1.4 MPa). Conditions at the well 12 determine operating pressures, the length of the stages and the number of stages. The system 10 of the present invention can operate with multiple stages of tubing and pumps in series and, thus, can operate at lower pressures. When high density polyethylene (HDPE) pipe is used inside the well 12 as the tubing string 64, 66 or 68, the system 10 has a limitation on the pressure that can be applied due to the limitations of HDPE tubing. Other types of plastic resin, stainless steel or fiber glass pipe can operate at higher pressures with the same utility and longer stages can be run with stainless or fiber glass. However, a larger compressor 22 is required, capable of producing mores pressures.

The natural gas capturing and deployment system 10 expands the scope and type of wells 12 that can benefit from enhancements realized from the application of the system. The system 10 can capitalize on pressures in the wellbore of the well 12 and lift more fluid 13 with fewer pump stages. The system 10 employs the use of the compressors and pressure regulators to limit the pressure in the well to lift fluid 13 from the pump 60. The excess gas pressurizes the system 10 faster and yields more excess gas being produced and delivered for sale or further processing. It will be appreciated that system 10 may comprise multiple pumps 60 connected to more than one tubing string 16 with the pump connected to each tubing string.

It now will be appreciated that the discharge pressure regulator 42 operates to maintain sufficient pressure on the pump 60 to lift fluid 13 while simultaneously allowing natural gas in excess of what is needed for the pump 60 to pass through the discharge pressure regulator 42 and into a gas flow line 70 for transport to a separators/tank battery facility, or into a combined flow line 74 with the fluid that is being pumped from the well 12. The compressor 22, bypass pressure regulator 48, and discharge pressure regulator 42 work together to achieve and maintain sufficient operating pressure for the pump 60, but at the same time maintain a low pressure on the annulus 19 of the well as well as on the discharge line 66 from pump 60.

Figure 6:
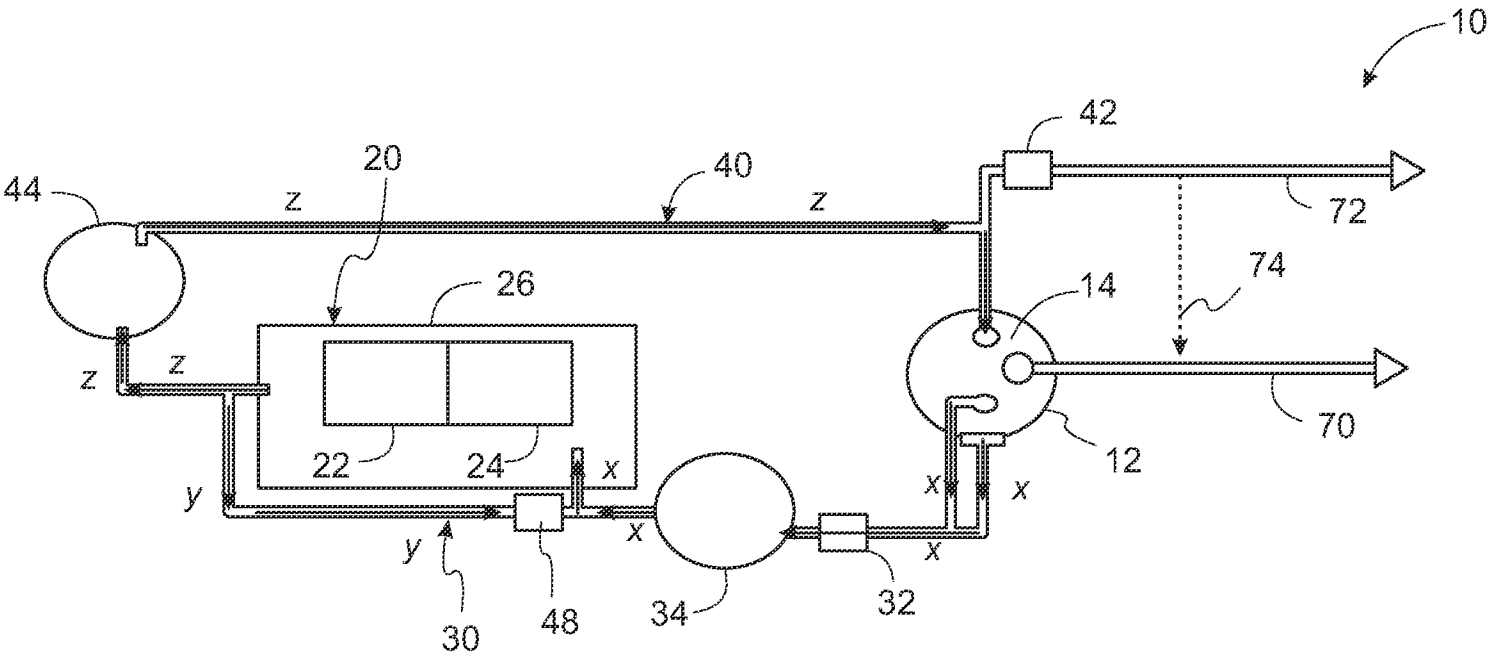
FIG. 6 is a schematic illustration and flow diagram of an illustrative gas capturing and deployment system constructed in accordance with an embodiment of the present invention.

Turning now to FIG. 6, the operation of the system 10 is described. The system 10 provides a closed loop whereby natural gas at the wellhead 14 is captured and processed through the compression system 20. After the pump 60 and compression system 20 are installed with the well 12, the annulus 19 of the well is opened to allow natural gas to flow in the direction of arrow x through the connections 50 and 52, shown in FIG. 1, into the suction scrubber 34 and, from there, into the compressor 22 of the compression system 20. Once natural gas is available at the suction side 30 and the compression system 20 from the wellhead 14, the compression system can be initialized using the driver 24 of the compression system 20. The compressor 22 will then begin to compress natural gas flowing from the wellhead 14 until the operating pressure set by the discharge pressure regulator 42 is achieved and the pump is activated.

If necessary, the bypass regulator 48 allows natural gas to circulate from the discharge side 40 in the direction y of the compressor to the suction side 30 until a sufficient volume of gas is achieved to fully charged the system 10 at an appropriate operating pressure for the pump 60. At that point, the pump 60 will start delivering fluid 13 from the well 12 into the flow line 70, which then goes to a separator/tank facility for normal processing. As the amount of natural gas available from the wellhead 14 exceeds what is required to charge and maintain the operating pressure for the pump 60, gas will exit the system 10 through the discharge pressure regulator 42, to the gas flow/sales line 72 for sale or other use.

FIG. 6 illustrates the flow in direction z of natural gas from the wellhead 14 through the compression system 20, and then returning either to the pump 60 to lift fluid 13 from the well 12 or exiting the system 10 as excess gas, which is then collected with a dedicated gas flow/sales line 72. Optionally, natural gas from the system 10 can be combined through line 74 with the fluid 13 from the pump 60 into a main flow line 70, which then can be processed at the separator/tank facility associated with the well 12.

Example 1

The efficiency and utility of a system for capturing natural gas constructed in accordance with the present invention 10 is demonstrated by the following example. Three oil and gas producing wells located on a lease in Osage County, Oklahoma that were drilled to a depth of 2,000 feet were identified as prospective for the installation of the system 10. Production from the three wells at the time of installation was approximately six barrels of oil per day, along with approximately 30 to 40 barrels of salt water per day. Each well was capable of producing from about 15 MCF per day (about 424,752.7 MCM per day) to about 30 MCF per day (about 849,505.4 MCM per day) of natural gas if released at low pressure from the annulus. After a pipeline was installed to transport gas to a nearby gas gathering delivery point, a system 10 of the present invention was installed on an experimental and testing basis in each of the three wells using equipment and labor customary for work on wells of this type and depth. The systems were tested for a period of 90 days, during which time oil production of the wells increased by approximately 30% from 6 to 8 barrels of oil per day. The increase in oil production was largely attributed to the reduction in average annular pressure on each well due to the installation of the system 10. Natural gas previously vented at the wellhead was captured by the systems 10 installed, and then delivered by gas flow lines to the pipeline installed. This resulted in 55 to 60 MCF per day (about 1,557,426.6 MCM per day to about 1,699,010.8 MCM per day) of natural gas being delivered and sold to a gas pipeline, instead of venting into the atmosphere. Operating costs were reduced by approximately $500 per month per well, or a 30% reduction in cost, while oil and gas revenue were increased as a result of installing the system 10 in each well. Increase in revenue came from both increased productivity of oil production, and sale of natural gas previously venting at the wellhead. Based on the success of the trial, the systems have remained installed and continue to produce successfully.

Example 2

The efficiency and utility of the system 10 constructed in accordance with the present invention is demonstrated by the following additional example. Twelve oil and gas wells located on a lease in Osage County, Oklahoma were selected for installation of the system 10 on an experimental and testing basis. Each of the wells was drilled to a depth between 1,700 feet and 2,000 feet and was completed in a low-pressure Pennsylvanian Sand formation reservoir. There was not a gas gathering line installed on the lease to collect natural gas from the wells, and the wells would not produce fluid under conditions where the annulus was shut-in due to pressure build up that would restrict fluid entry. The wells had been alternately produced occasionally as fluid entry into the well bores would allow. The lease was averaging approximately one barrel of oil per day and was not selling gas at the time the systems 10 were installed. After installing a system 10 in each of the wells, average oil production increased from about one barrel per day (about 159 liters), to an average of about seven barrels (about 1113 liters) per day, or a 700% increase. Each system 10 was installed so that excess gas could be combined with fluid 13 from the well 12 as indicated by line 74 of FIG. 6. This allowed excess natural gas to be transported to a central processing facility where the natural gas could be separated and delivered to a gas sales pipeline. As a result of installing the experimental systems 10, the wells are selling 40 MCF per day (about 113,267.4 MCM per day) of natural gas that previously had been shut in, or was venting at the wellhead of the wells into the atmosphere.

The methods of the invention will now be described. The foregoing description is incorporated into the description of the methods of the invention. The invention includes a method for capturing natural gas at a wellhead of a hydrocarbon-producing well, comprising the steps of capturing natural gas that is being produced at the well, and utilizing the captured natural gas to create a pressurized system to lift hydrocarbons from the well. The step of capturing natural gas that is being produced from the well may further comprise the step of scrubbing fluids from the captured natural gas. The step of scrubbing fluids from the captured natural gas further comprises the step of compressing the natural gas flowing from the wellhead until a desired operating pressure is achieved at the wellhead. The method may further comprise the step of returning captured natural gas to the wellhead to lift additional hydrocarbons from the well. The method may further comprise the step of delivering the captured natural gas to a gas flow line, either alone or in combination with hydrocarbons from the well, for additional processing, without increasing the pressure. The method may further comprise the step of recompressing the captured natural gas and recirculating the captured natural gas through the pressurized system. When the captured natural gas exceeds that which is required maintain the pressurized system and produce hydrocarbons from the well, the excess captured natural gas may be delivered for processing.

The method of the invention also includes a method for enhancing efficiency and productivity of a hydrocarbon-producing well, comprising the steps of capturing natural gas that is being produced at the well, and utilizing the captured natural gas to create a pressurized system to lift hydrocarbons from the well. The step of capturing natural gas that is being produced from the well may further comprise the step of scrubbing fluids from the captured natural gas. The step of scrubbing fluids from the captured natural gas further comprises the step of compressing the natural gas flowing from the wellhead until a desired operating pressure achieved at the wellhead. The method may further comprise the step of returning captured natural gas to the wellhead to lift additional hydrocarbons from the well. The method may further comprise the step of delivering the captured natural gas to a gas flow line, either alone or in combination with hydrocarbons from the well, for additional processing, without increasing the pressure. The method may further comprise the step of recompressing the captured natural gas and recirculating the captured natural gas through the pressurized system. When the captured natural gas exceeds that which is required maintain the pressurized system and produces hydrocarbons from the well, the excess captured natural gas may be delivered for processing.

It now will be appreciated that the present invention presents a new system for capturing gas and for enhancing the production and efficiency of a well. The present invention eliminates the problems created by venting or flaring natural gas containing methane and other hydrocarbons into the atmosphere and threatening the environment. The present invention avoids the buildup of pressure in the annular space of a well, which impedes the flow of fluids into the well bore, thereby reducing the productive capacity of the well for marketable fluids. The present invention provides a pressurized system which can be utilized to lift fluid in the well, in the place of current and costly conventional equipment, and transports that fluid through flow lines to tank facilities by utilization of a specialized pump. The present invention provides sufficient gas pressure so that excess natural gas can be delivered into a gathering flow line or reintroduced into a primary combined flow line with the fluid, where the natural gas can then be separated at a tank battery facility. The present invention can be utilized to replace both surface compressors and conventional rod-lift pump equipment, so that operating costs are reduced, and production efficiency is increased. The present invention also reduces the operating costs associated with maintenance and production of a well because of lower costs compared with conventional pumps and equipment, thus extending the productive life of current wells without venting of natural gas into the atmosphere The invention has been described above both generically and with regard to specific embodiments. Although the invention has been set forth in what has been believed to be preferred embodiments, a wide variety of alternatives known to those of skill in the art can be selected with a generic disclosure. Changes may be made in the combination and arrangement of the various parts, elements, steps and procedures described herein without departing from the spirit and scope of the invention as defined in the following claims.

I claim:

1. A closed-loop system for capturing and deploying natural gas at a wellhead of a hydrocarbon-producing well, the well having a tubing string and a production casing and forming an annulus therebetween, the system comprising:

a suction side;

a discharge side;

a compression system in fluid communication with the wellhead and with the suction side and the discharge side, the compression system comprising:

a compressor; and a driver to power the compressor;

a discharge pressure regulator in fluid communication with the discharge side and with the well for controlling the pressure of the closed-loop system; and a downhole pump configured to be in fluid communication with the compression system wherein the downhole pump employs gas pressure to lift fluids from the well independently from the operations of the well in the annulus and maintains a substantially constant low pressure on the annulus between about 0 to about 1 psi.

2. The closed-loop system of claim 1 wherein the compression system separates natural gas from the fluid supplied from the well and wherein the closed-loop system further comprises a bypass regulator in fluid communication with the compression system to allow bypass of natural gas from discharge side to the suction side to independently from the operations of the well in the annulus and maintain substantially constant low pressure on the annulus without adding pressure to the well.

3. The closed-loop system of claim 1, wherein the compressor of the compression system comprises a reciprocating cylinder compressor, a rotary screw compressor, an axial compressor or a centrifugal compressor.

4. The closed-loop system of claim 1 wherein the downhole pump comprises a gas lift pump or a bubble pump configured to be in fluid communication with the compressor.

5. The closed-loop system of claim 1, wherein the pump is installed within the annulus of the well and is adapted to be connected to the suction side of the compression system or to the discharge side of the compression system, or both.

6. The closed-loop system of claim 4, further comprising a suction pressure regulator in fluid communication with the downhole pump to control pressure at the wellhead.

7. The closed-loop system of claim 6, wherein the suction pressure regulator is selected from the group consisting of evaporating pressure regulators, condensing pressure regulators, crankcase pressure regulators, capacity regulators, and hot-gas bypass regulators, back pressure regulators, vacuum pressure regulators, differential regulators, or pressure reducing regulators.

8. The closed-loop system of claim 6, further comprising a suction scrubber in fluid communication with the suction side and with the suction pressure regulator to receive natural gas from the well and to allow condensation and accumulation of fluids from a natural gas stream produced from the well, prior to entering the compression system.

9. The closed-loop system of claim 2, wherein the discharge pressure regulator is in fluid communication with the downhole pump to control pressure at the wellhead.

10. The closed-loop system of claim 2, wherein the discharge pressure regulator is configured to maintain operating pressures on the discharge side and allow excess gas to be released.

11. The closed-loop system of claim 9, further comprising a discharge scrubber in fluid communication with the discharge side and with the discharge pressure regulator to receive natural gas from the compression system and condense fluids from the natural gas after exiting the compression system.

12. The closed-loop system of claim 11, wherein the bypass pressure regulator is configured to allow the bypass of natural gas from the discharge side to the suction side when there is insufficient gas available from the well to selectively pressurize the pump or the closed-loop system.

13. The closed-loop system of claim 1, wherein the downhole pump defines a pump chamber and three tubing strings and the downhole pump is configured to have a filling cycle and a pumping cycle, wherein, as fluids from the wellbore fill the pump chamber during the filling cycle, gas is vented from the pump chamber through a first tubing string as displaced by fluid in the pump.

14. The closed loop system of claim 13 further comprising a float switch, wherein, after the pump chamber has filled, the float switch activates to allow compressed gas to enter the pump chamber through a second tubing sting to displace fluid in the pump.

15. The closed loop system of claim 14, wherein, as compressed gas enters the pump, it displaces the fluid in the pump and lifts the fluid toward the surface through a third tubing string.

16. The closed loop system of claim 15, wherein the pump further is configured to have a pumping cycle, wherein, as compressed gas continues to displace fluid from the pump through the third tubing string, the float switch deactivates and stops the flow of gas into the pump through the second tubing string and allows fluid to enter the pump again.

17. The closed-loop system of claim 16 wherein:

the compression system utilizes natural gas supplied from the well and the closed-loop system further comprises a bypass regulator in fluid communication with the compression system to allow bypass of natural gas from discharge side to the suction side independently from the operations of the well in the annulus and maintain substantially constant low pressure on the annulus without adding pressure to the well;

the discharge pressure regulator is in fluid communication with the downhole pump to control the system operating pressure at the wellhead; and the pressure of the annulus is controlled during each filling cycle and each pumping cycle without adding pressure to the annulus of the well.

18. A unit for capturing and deploying natural gas in a closed-loop at a wellhead of a hydrocarbon-producing well, the well having a tubing string and a production casing and forming an annulus therebetween, the unit comprising:

a suction side;

a discharge side;

a compression system in fluid communication with the wellhead and with the suction side and the discharge side, the compression system comprising:

a compressor; and a driver to power the compressor;

a discharge pressure regulator in fluid communication with the discharge side and with the well for controlling the pressure of the closed-loop system; and a downhole pump configured to be in fluid communication with the compression system wherein the downhole pump employs gas pressure to lift fluids from the well independently from the operations of the well in the annulus and maintains substantially constant low pressure on the annulus between about 0 to about 1 psi.

19. The unit of claim 18 wherein the compression system separates natural gas from the fluid supplied from the well and wherein the unit further comprises a bypass regulator in fluid communication with the compression system to allow bypass of natural gas from discharge side to the suction side to independently from the operations of the well in the annulus and maintain substantially constant low pressure on the annulus without adding pressure to the well.

20. The unit system of claim 18, wherein the compressor of the compression system comprises a reciprocating cylinder compressor, a rotary screw compressor, an axial compressor or a centrifugal compressor.

21. The unit of claim 18 wherein the downhole pump comprises a gas lift pump or a bubble pump configured to be in fluid communication with the compressor.

22. The unit of claim 18, wherein the pump is installed within the annulus of the well and is adapted to be connected to the suction side of the compression system or to the discharge side of the compression system, or both.

23. The unit of claim 21, further comprising a suction pressure regulator in fluid communication with the downhole pump to control pressure at the wellhead.

24. The unit of claim 23, wherein the suction pressure regulator is selected from the group consisting of evaporating pressure regulators, condensing pressure regulators, crankcase pressure regulators, capacity regulators, and hot-gas bypass regulators, back pressure regulators, vacuum pressure regulators, differential regulators, or pressure reducing regulators.

25. The unit of claim 23, further comprising a suction scrubber in fluid communication with the suction side and with the suction pressure regulator to receive natural gas from the well and to allow condensation and accumulation of fluids from a natural gas stream produced from the well, prior to entering the compression system.

26. The unit of claim 19, wherein the discharge pressure regulator is in fluid communication with the downhole pump to control pressure at the wellhead.

27. The unit of claim 19, wherein the discharge pressure regulator is configured to maintain operating pressures on the discharge side and allow excess gas to be released.

28. The unit of claim 26, further comprising a discharge scrubber in fluid communication with the discharge side and with the discharge pressure regulator to receive natural gas from the compression system and condense fluids from the natural gas after exiting the compression system.

29. The unit of claim 28, wherein the bypass pressure regulator is configured to allow the bypass of natural gas from the discharge side to the suction side when there is insufficient gas available from the well to selectively pressurize the pump or the closed-loop system.

30. The unit system of claim 18, wherein the downhole pump defines a pump chamber and three tubing strings and the downhole pump is configured to have a filling cycle and pumping cycle, wherein, as fluids from the wellbore fill the pump chamber during the filling cycle, gas is vented from the pump cavity through a first tubing string as displaced by fluid in the pump.

31. The unit of claim 30 further comprising a float switch, wherein, after the pump chamber has filled, the float switch activates to allow compressed gas to enter the pump chamber through a second tubing sting to displace fluid in the pump.

32. The unit of claim 31, wherein, as compressed gas enters the pump, it displaces the fluid in the pump and lifts the fluid toward the surface through a third tubing string.

33. The unit of claim 32, wherein the pump further is configured to have a pumping cycle, wherein, as compressed gas continues to displace fluid from the pump through the third tubing string, the float switch deactivates and stops the flow of gas into the pump through the second tubing string and allows fluid to enter the pump again.

34. The unit of claim 26 wherein:

the compression system utilizes natural gas supplied from the well and the unit further comprises a bypass regulator in fluid communication with the compression system to allow bypass of natural gas from discharge side to the suction side independently from the operations of the well in the annulus and maintain substantially constant low pressure on the annulus without adding pressure to the well;

the discharge pressure regulator is in fluid communication with the downhole pump to control system operating pressure at the wellhead; and the pressure of the annulus is controlled during each filling cycle and each pumping cycle without adding pressure to the annulus of the well.

* * * * *